United States Patent [19]

Mason

[11] Patent Number: 4,558,637

[45] Date of Patent: Dec. 17, 1985

[54] ROOF RIDGE VENTILATOR IMPROVEMENTS

[76] Inventor: Reginald E. Mason, 1151 Victoria Park Ave., Toronto, Ontario, Canada, M4B 2K5

[21] Appl. No.: 588,241

[22] Filed: Mar. 12, 1984

[30] Foreign Application Priority Data

Mar. 11, 1983 [CA] Canada ..... 423455

[51] Int. Cl.[4] ..... F24F 7/02

[52] U.S. Cl. ..... 98/42.21; 52/199

[58] Field of Search ..... 98/42 R, 42 A; 52/199

[56] References Cited

U.S. PATENT DOCUMENTS

| | | | |
|---|---|---|---|
| 313,852 | 3/1885 | Cortright | 98/42 A |
| 865,961 | 9/1907 | Zilly | 98/42 A |
| 2,799,214 | 7/1957 | Roose | 98/42 A |
| 3,520,245 | 7/1970 | Painter | 98/42 R |
| 4,138,935 | 2/1979 | Vallée | 98/42 A |
| 4,280,399 | 7/1981 | Cunning | 98/42 A |

FOREIGN PATENT DOCUMENTS

| | | | |
|---|---|---|---|
| 2356782 | 5/1975 | Fed. Rep. of Germany | 52/199 |
| 0056292 | 7/1982 | Netherlands . | |

*Primary Examiner*—Harold Joyce
*Attorney, Agent, or Firm*—Moss, Hammond

[57] ABSTRACT

Apparatus is disclosed for ventilating a roof space or attic, particularly at the ridge or along the hip of the roof. The apparatus includes support members for supporting and spacing roof ridge tiles or cover elements above the roof surface at the ridge or hip. The ridge or hip and the support members have vent openings for passage of air therethrough and out from under the ridge or hip tiles. The support members straddle the ridge or hip and have longitudinal side portions with outwardly disposed louvres. The support members also have central, inverted-V inner portions connecting the side portions at the respective bases thereof. The inner portions have upper louvres and shield portions located adjacent to the side portion louvres to prevent precipitation from passing in through the support members and down through the roof ridge vent openings. In some embodiments, the inverted-V inner portions have flexible skirts attached to and depending from the shield portions thereof to fill and seal any uneveness in the roof surface.

16 Claims, 10 Drawing Figures

ROOF RIDGE VENTILATOR IMPROVEMENTS

This invention relates to ventilators, and in particular, to devices for ventilating roof spaces, such as attics, crawl spaces, and the like.

It is well known that roof spaces, such as attics, must be ventilated in most climates, or condensation or heat accumulation will cause considerable damage or discomfort or inefficient heating or cooling of the building usable space. One of the most common methods of ventilating a roof space used in the past is to provide dome or spot type ventilators which provide localized ventilation in the roof surface, and additional vent openings or louvres lower down on the roof in the area of the soffit and fascia or in the roof gables. A difficulty with this type of ventilation is that the dome type ventilators mounted on the roof are unsightly in appearance. Further, these dome ventilators are not as efficient as they could be, because they cannot usually be mounted in the best location which is usually at the peak or highest point on the roof.

As an improvement over the conventional dome ventilators, roof ridge ventilators have been used in the past. These are ventilators that are mounted right on the roof ridge with suitable vent openings being made in the roof ridge to allow air within the roof space to pass through the ridge and out through the ventilator. While these roof ridge ventilators used in the past are most efficient due to their mounting location, they too suffer the disadvantage of being unsightly in appearance. This is particularly important in the case of clay or concrete tile roofs where it is undesirable to have anything mounted on the roof to detract from the overall appearance of these roofs. Further, many of the prior art ridge ventilators are not completely weatherproof or prevent the entry of pests as well as they should.

The roof ridge ventilator of the present invention is particularly desirable for concrete, clay, steel or other material roof tiles used in tile roofs, because it raises the ridge tiles only slightly to permit ventilation but in a weatherproof manner, and yet the ridge ventilator is inconspicuous.

According to the invention, there is provided a roof ridge or hip ventilator for longitudinal location along a roof ridge or hip having openings for the passage of air through the roof surface. The ventilator comprises an elongate support member adapted to be located longitudinally, straddling the ridge or hip openings. The support member has longitudinal side portions for spacing roof ridge or hip cover elements above the roof surface. The side portions have means defining vent openings for the passage of air therethrough. The support member also has a central inner portion connecting the longitudinal side portions, the inner portion having shield portions located adjacent to the side portion vent openings to prevent precipitation passing inwardly through the support member. The central portion also has means defining vent openings communicating with the ridge or hip openings and the side portion vent openings for the venting of air through the roof ridge or hip with the ridge or hip cover elements in place.

Preferred embodiments of the invention will now be described, by way of example, with reference to the accompanying drawings, in which.

Figure 1:
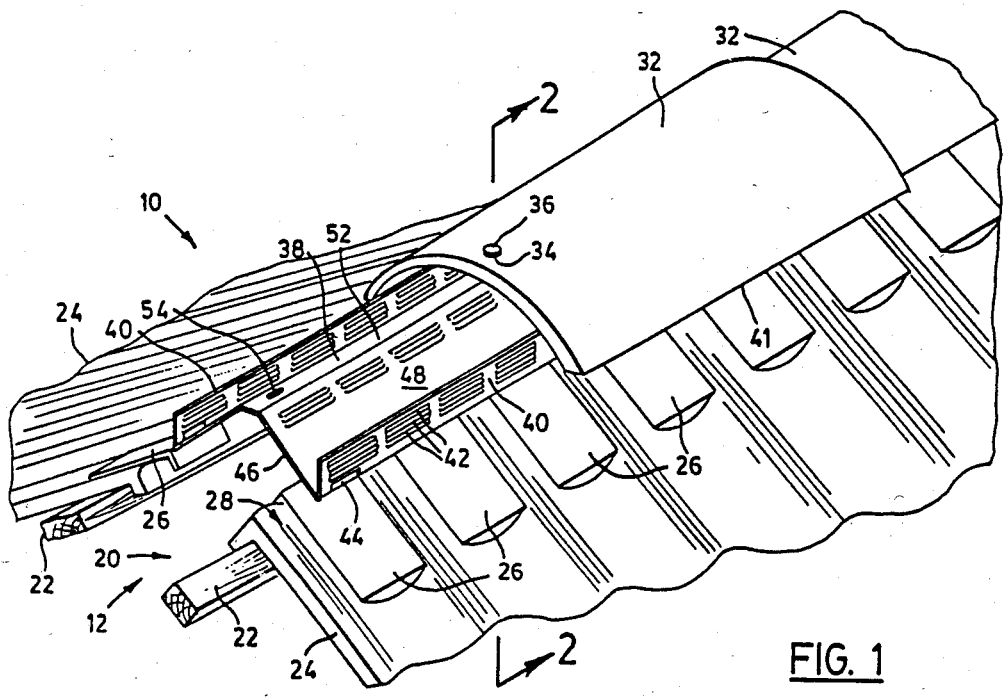
FIG. 1 is a perspective view of a portion of a roof ridge showing a preferred embodiment of the roof ridge ventilator of the present invention installed thereon.
Figure 2:
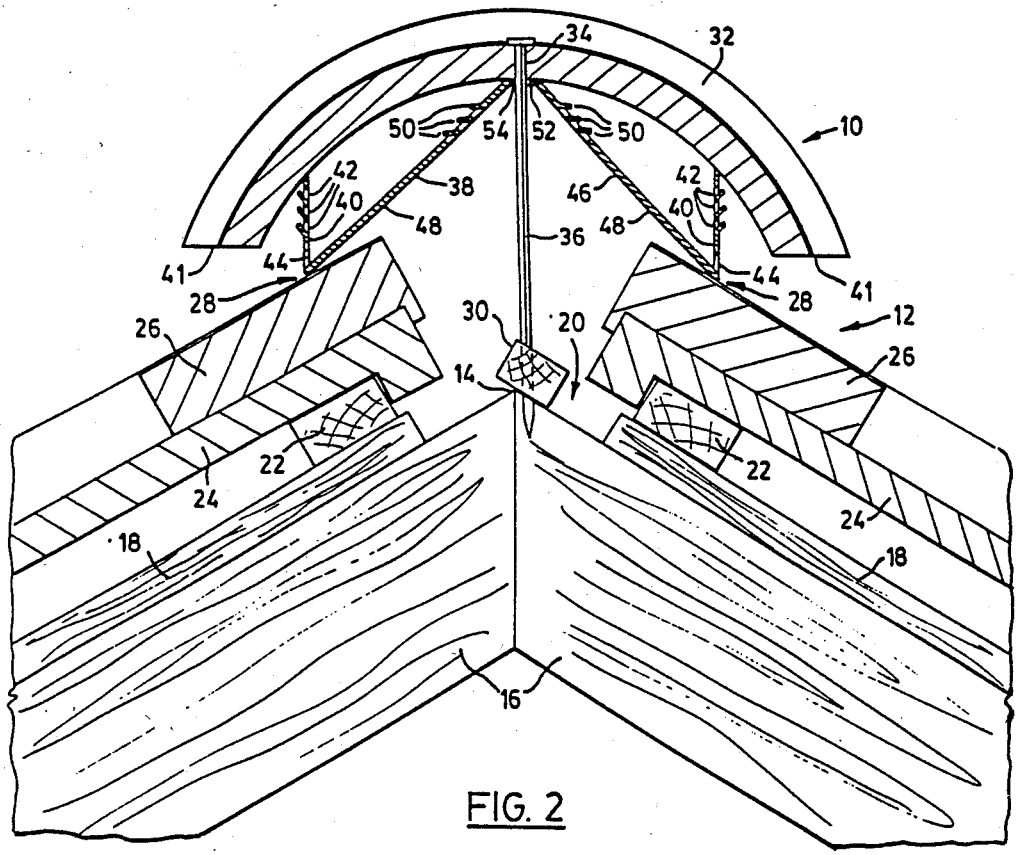
FIG. 2 is a sectional view taken along lines 2—2 of FIG. 1, but on an enlarged scale.

Referring firstly to FIGS. 1 and 2, there is shown a portion of a roof ridge wherein a preferred embodiment of a roof ridge ventilator according to the present invention is installed and is generally indicated by reference numeral 10. Ridge ventilator 10 is shown installed on a roof ridge 12 which is of conventional construction for a clay or concrete tile type roof, although ventilator 10 could be installed on a roof hip if desired. For the purposes of this disclosure, the term "ridge" shall include a roof hip or any other peaked area of a roof. The construction of the tile roof per se is not considered to be part of the present invention and is described merely as a typical type of roof construction with which the roof ridge ventilator of the present invention can be used. However, to the extent that the typical tile roof construction has been modified by the invention, this is considered to be part of the invention in one of its aspects.

A typical tile roof ridge 12 has a peak 14 (see FIG. 2) formed by roof trusses or rafters 16. Roof boards 18, which are typically formed of plywood, chipboard, fiberboard or felt or any other underlay material, are laid over rafters 16 to cover the roof but leaving the peak open to form longitudinally arranged ridge openings 20 between rafters 16 for the passage of air through the roof ridge. Battens 22 are mounted parallel to the roof ridge and are attached to roof trusses or rafters 16 in a conventional manner. Roof tiles 24 are then positioned over battens 22 and clipped or nailed in place, again in a conventional manner. Roof tiles 24 can be in any shape desired and are overlapped or interlocked to make the roof weatherproof. In the embodiment shown in FIGS. 1 and 2, dentil slips 26 are located in the valleys of roof tiles 24 at the ridge to give a generally flat longitudinal surface 28 along the upper peripheral edges of each side of the roof. Dentil slips 26 are shown hooked over roof tiles 24, but they could be wired or cemented in place as desired. A central ridge batten 30 (see FIG. 2) is mounted at the peak of the ridge and is conventionally used for securing roof ridge or hip cover elements or ridge tiles 32 in position. As seen best in FIG. 1, ridge tiles 32 are overlapped and have openings 34 adjacent one end for attaching the ridge tiles 32 to ridge batten 30. Normally, ridge tiles 32 are wired to ridge batten 30, but they may be nailed in place using nails 36 as shown in the drawings.

The roof components described so far are those that are used in a conventional or typical tile roof construction. A preferred embodiment of the invention and the modification of the conventional roof construction to employ same will now be described below.

Figure 3:
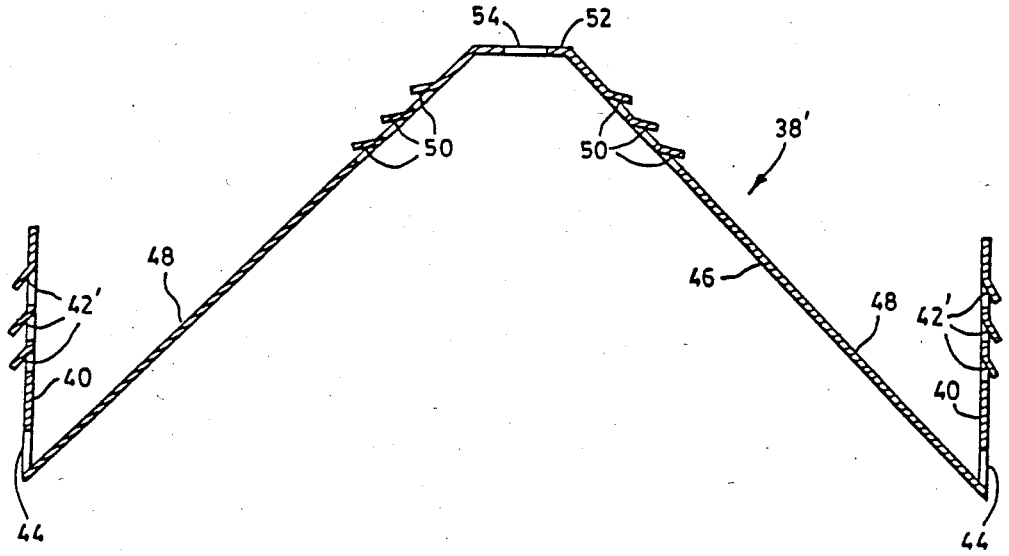
FIG. 3 is a transverse sectional view of the support member shown in FIGS. 1 and 2, but showing a modification to the embodiment shown in these Figures.

A preferred embodiment of the roof ridge ventilator has an elongate support member 38 which is mounted longitudinally along the roof ridge 12 to cover or straddle the roof ridge openings 20. Support member 38 has longitudinal, generally upright side portions 40 which support ridge tiles 32 in a spaced or raised position above the roof surface. The peripheral edges 41 of ridge tiles 32 are typically spaced 13 to 19 mm from the flat longitudinal surfaces 28 of the roof. Side portions 40 have vent openings or louvres 42 for the passage of air therethrough. As will be seen best in FIG. 2, these louvres are generally upwardly and outwardly opening to help prevent the entry of precipitation such as rain or snow coming in from under ridge tiles 32. However, the louvres could be downwardly and outwardly opening as indicated by louvres 42' of support member 38' in FIG. 3. Side portions 40 also have spaced-apart, lower drain openings 44 located at the base or along the lower edge of each side portion for the escape of any moisture such as precipitation or condensation that should enter or form on the inside of side portions 40.

The support member 38 also has a central inner portion 46 connecting the lower edges of the longitudinal side portions 40. Central inner portion 46 has shield portions 48 located adjacent to the side portion vent openings or louvres 42 to prevent any precipitation that may pass inwardly through louvres 42 from also passing through the support member 38 and into the ridge opening 20. Central inner portion 46 also has vent openings or louvres 50 which are located remote from the lower edges of side portions 40 in communication with the side portion vent openings or louvres 42 and the ridge openings 20, so that air may be vented through the roof ridge with the ridge tiles in place. Central inner portion 46 is convex or of inverted V-shape and is connected to the bases or lower edges of the respective longitudinal side portions 40. As seen best in FIG. 2, the top or apex or crest 52 of inner portion 46 also supports the ridge tiles 32. Crest 52 is formed with top, spaced-apart slots 54 through which nails 36 pass to secure support member 38 and tiles 32 in position. It will be appreciated that louvres 50 are located adjacent to the top or crest 52 of support member 38, so that the shield portions 48 are located opposite the side portion vent openings or louvres 42 to prevent precipitation passing inwardly through support member 38 and into the roof ridge openings 20 as mentioned above. Louvres 50 are shown to be horizontally and outwardly opening, but they could be upwardly opening or some other arrangement if desired.

Support members 38 are formed of aluminum or galvanized sheet metal, plastic or other suitable corrosion or weather resistant material and are supplied in lengths approximately 2 meters long. The support members 38 are typically about 16 cm in width and 7 cm in height. It will be appreciated that the lengths and dimensions of the support members 38 can be chosen as desired. Further, the number and dimensions of the louvres can be modified as desired to give any desired air flow therethrough. Since the amount of air passing through the roof ridge is determined by the spacing between the ridge tile peripheral edges 41 and the flat longitudinal roof surfaces 28, the support member louvres need only be dimensioned so as not to restrict this flow. Support members 38 may be roll formed or press brake formed with the louvres, drain openings and fastener slots being punched out in a conventional manner.

Figure 4:
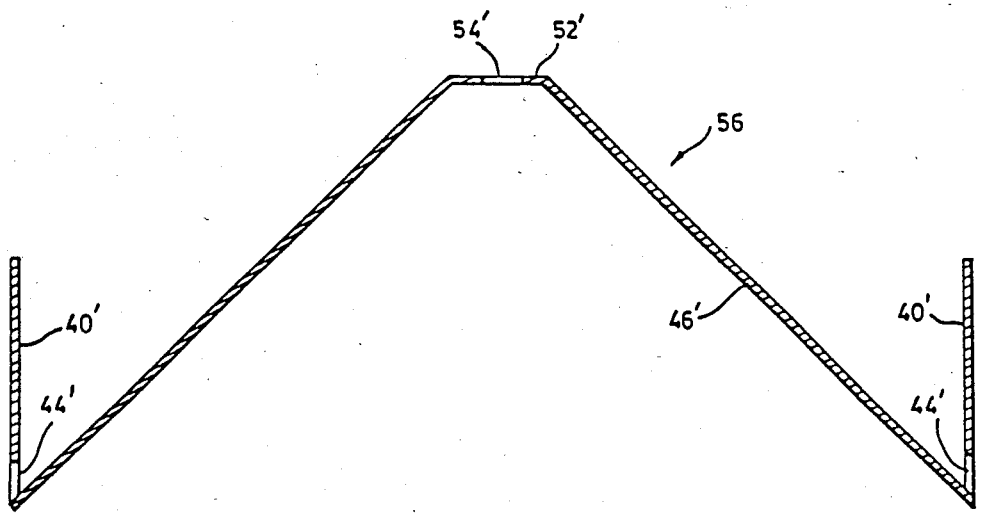
FIG. 4 is a view similar to FIG. 3 but showing another embodiment of support member having no vent openings.

In the case of most roofs, it is not necessary to have ridge venting along the entire length of the ridge in order to satisfy the ventilation requirement. In order to match the amount of ventilation to the requirement, support members 56 as shown in FIG. 4 are used in conjunction with support members 38. Support members 56 have no vent openings or louvres in either the side portions or the central inner portion. Otherwise, support members 56 are identical to support members 38 including lower drain openings 44', and primed reference numerals are used in FIG. 4 to indicate the parts which are similar to those of support members 38 or 38' shown in FIGS. 1 to 3. The dimensions and material used for support members 56 are otherwise the same as for support member 38. It will be appreciated that with the use of the non-louvred support members 56 in association with the louvred support members 38 or 38', the amount and location of the ridge venting for any particular roof can be chosen as desired, but the appearance of the roof is the same throughout. Other than a small gap between the peripheral edges 41 of the ridge tiles 32 and the roof surface, the roof ridge ventilators are not visible and are inconspicuous in use.

Figure 5:
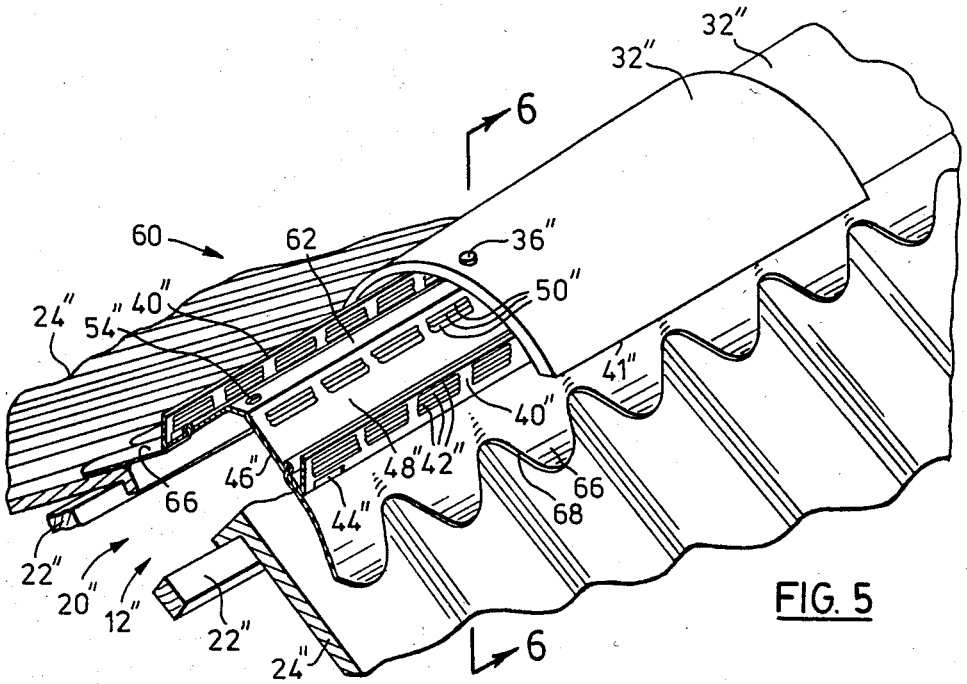
FIG. 5 is a perspective view similar to FIG. 1, but showing another embodiment of a roof ridge ventilator according to present invention.
Figure 6:
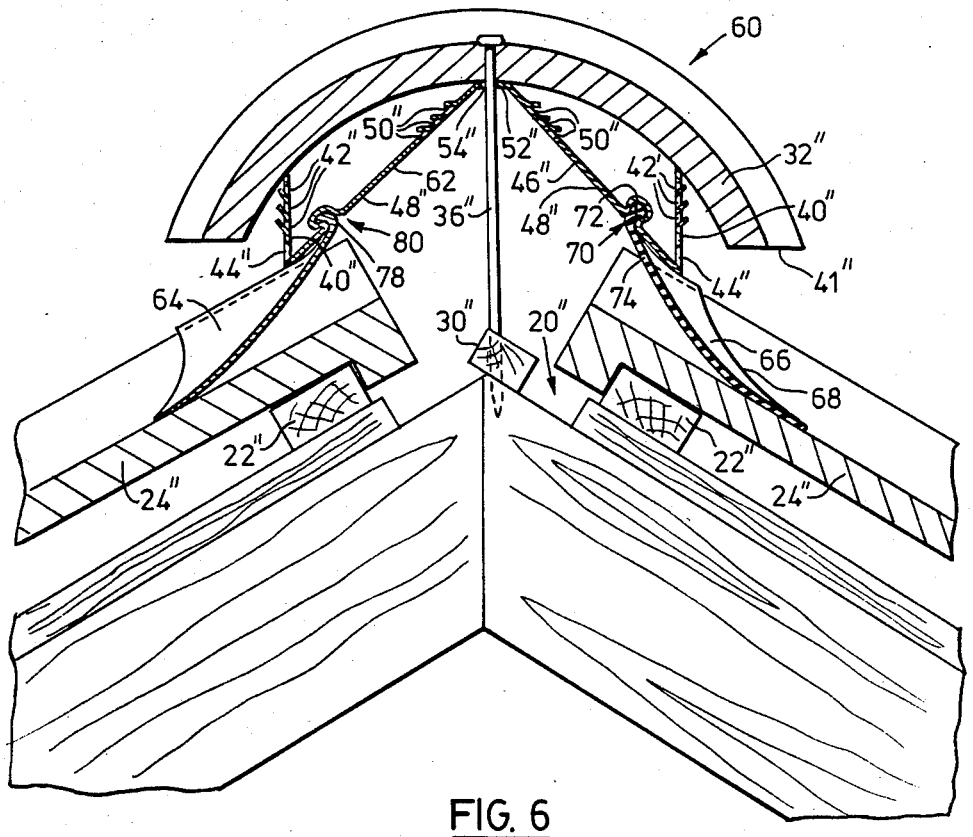
FIG. 6 is a sectional view taken along lines 6—6 of FIG. 5 on an enlarged scale, but showing a modification to the sealing skirts of the FIG. 5 embodiment.
Figure 7:
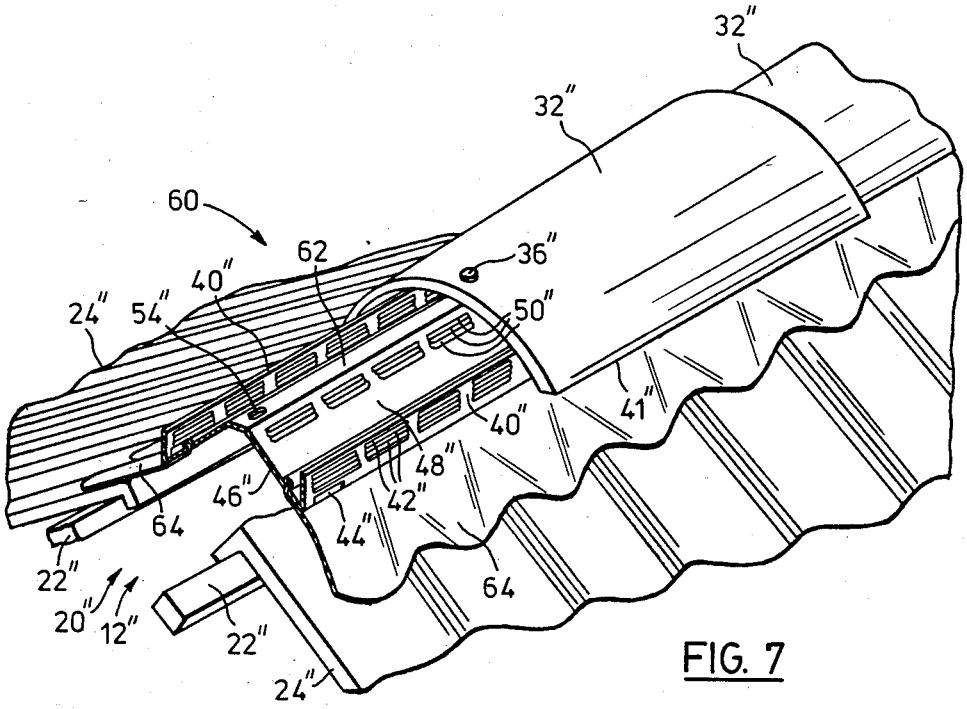
FIG. 7 is a perspective view similar to FIGS. 1 and 5 showing a roof ridge ventilator with a lead longitudinal sealing skirt.

Referring next to FIGS. 5 to 10, double primed reference numerals are used to indicate parts of the roof ridge ventilators shown in these drawings which are similar to the parts shown in FIGS. 1 to 4. FIGS. 5 to 7 show another embodiment of roof ridge ventilator which is generally indicated by reference numeral 60. Ventilator 60 is used where it is desirable to delete the dentil slips 26 as shown in FIGS. 1 and 2. Roof ridge ventilator 60 has a support member 62 with integral longitudinal sealing skirts 64, 66 attached thereto. Sealing skirts 66 are formed of flexible material such as rubber or polyvinylchloride. Rubber is preferred because it is resilient or elastic. Sealing skirt 66 has a lower peripheral edge portion 68 that is scalloped or otherwise preshaped to conform to the contour of roof tiles 24''. As seen best in FIGS. 5 and 6, sealing skirt 66 is downwardly depending from the central inner portion 46'' of support member 62 and sealing skirt 64 completely fills the valleys in the roof tiles 24'' to prevent precipitation or foreign matter from passing under support member 62 into the ridge openings 20''. In fact, sealing skirts 66 seal more tightly the harder the wind blows against them.

As seen best in FIG. 6, sealing skirt 66 is attached to support member 62 at the shield portion 48'' of the support member central inner portion 46''. Longitudinal, C-shaped, downwardly opening retaining slots 70 are formed in the shield portions 48'', and the sealing skirts 66 have upper peripheral beads 72 slideably located in slots 70 for longitudinal movement of the sealing skirts 66 relative to support member 62. Longitudinal movement of sealing skirts 66 allows the pre-shaped lower peripheral edge 68 to be aligned with the valleys in roof tiles 24'', especially where the valleys in the roof tiles on one side of the roof ridge are not in alignment with the valleys in the roof tiles on the other side of the roof ridge.

Figure 9:
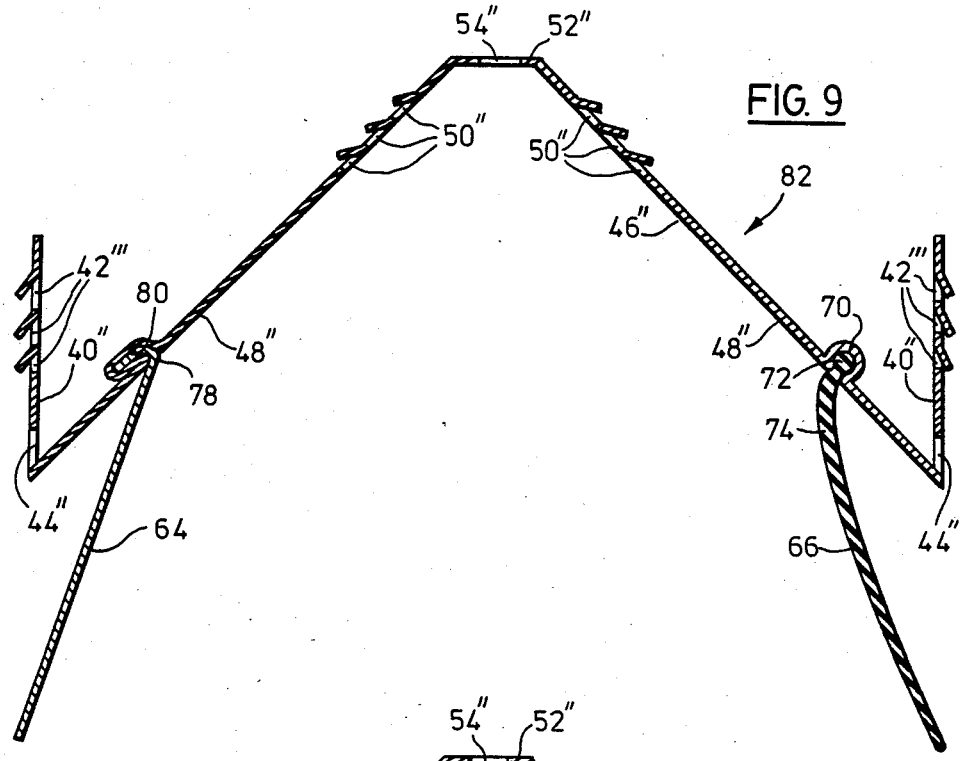
FIG. 9 is an enlarged transverse sectional view of the support member shown in FIG. 6 with some modifications.
Figure 10:
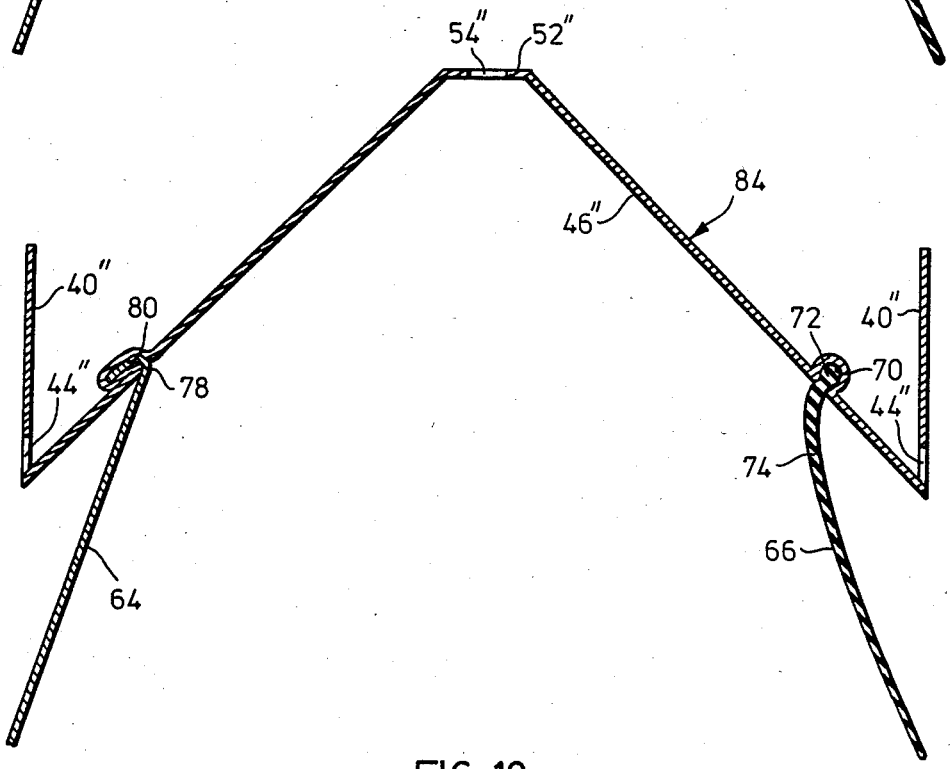
FIG. 10 is a view similar to FIG. 9 showing a similar support member having no vent openings.

As seen best in FIGS. 9 and 10, sealing skirts 66 have upper shoulder portions 74 that are thickened to help press sealing skirts 66 down into the valleys in the roof tiles and retain same therein. Alternatively, sealing skirts 66 could be of uniform thickness (except for beads 72) and other forms of reinforcement could be added to or incorporated into the material of the sealing skirts. A suitable material for sealing skirts 66 is E.D.P.M. rubber or neoprene having a Shore A hardness of about 60. The dimensions and shapes of the sealing skirts 66 depend on the type or contour of the roof tiles 24''.

Figure 8:
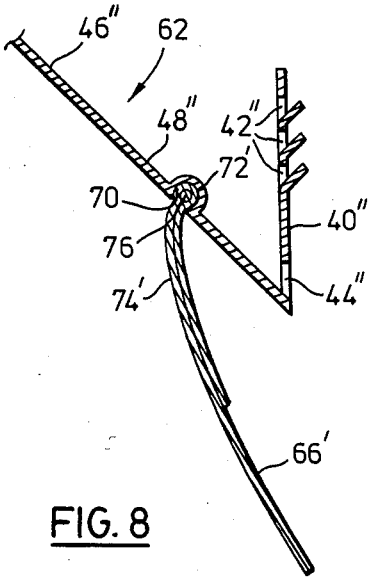
FIG. 8 is an enlarged transverse sectional view of a portion of the support member of the roof ridge ventilator shown in FIG. 5, but showing another embodiment of sealing skirt.

FIG. 8 shows a modified version of sealing skirt 66' wherein the upper shoulder portion 74' of the skirt is formed by wrapping the skirt around a cylindrical core 76 to form bead 72'. Core 76 could be any suitable flexible cord and the upper peripheral edges of sealing skirt 66' could be secured together using any convenient method, such as a suitable adhesive.

As seen best in FIGS. 6 and 7, sealing skirts 64 are formed of lead sheet material, typically about 10 kilograms per square meter. Sealing skirts 64 are attached to support members 62 in the area of shield portions 48'' by locating the top peripheral edge 78 in a roll-formed slot 80 and crimping the roll-formed slot to retain the top peripheral edge 78 in position. Sealing skirt 64 is uniform in width, and because the lead sheet is flexible ductile material, it can be shaped after installation of support member 62 to conform to the contour of the roof tiles 24'' as seen in FIG. 7. As a result, it is not necessary to pre-shape the lower peripheral edge portion of sealing skirt 64 to conform to the roof surface contour.

In FIG. 5, the pre-shaped rubber sealing skirts 66 are used in support members 62. In FIG. 7, the lead sheet sealing skirts 64 are used in support members 62. The lead sheet sealing skirts 64 are particularly useful where the roof tiles 24 have irregular contours, or where support members 62 are used along the hip of a roof. In the case of the application to a roof hip, the valleys of the roof tiles would intersect the hip at an angle, and therefore, the lead sheet sealing skirt 64 would be particularly convenient to install, as the ductile sealing skirts 64 can be easily shaped to conform to any roof contour. FIG. 6 shows a combination of sealing skirts 64, 66, but this is only for the purposes of illustration. Usually, support member 62 would only have one type of sealing skirt on both sides of the support member.

FIGS. 9 and 10 also show both types of sealing skirts 64, 66 in the same support member but this again is only for the purposes of illustration. Support member 82 shown in FIG. 9 corresponds with support member 38' shown in FIG. 3 and it has downwardly and outwardly opening louvres 42''' rather than upwardly and outwardly opening louvres 42'' as in the embodiments shown in FIGS. 5 to 8. Support member 84 as seen in FIG. 10 corresponds with support member 56 shown in FIG. 4, support member 84 having no louvres in central inner portion 46'' or side portions 40''. Again, a combination of support members 82, 84 would be used to produce the required amount of ventilation for any particular roof.

Having described preferred embodiments of the invention, it will be appreciated that various modifications may be made to the structures described. For example, the central inner portion 46 of support member 38, 56, 62, 82 or 84 could be other shapes or configurations, as could the type and dimensions of the louvres. Of course, the louvres could be replaced by simple vent openings or holes. Similar modifications could be made to the side portions and their vent openings. It is important, however, that the side portion vent openings be located adjacent to shield portions of the central inner portion, so that precipitation does not pass inwardly through the support member and into the roof ridge openings. The type of precipitation of concern is driving rain or snow which could enter the roof ridge from outside. It is also desirable to prevent foreign matter such as dirt, leaves, or pests, such as insects, rodents or birds from passing or being blown under or through the roof ridge tiles and into the ridge openings, so the louvres or openings should be dimensioned to prevent this.

Although the roof ventilators of the present invention have been described for use in association with peaked roofs, it will be appreciated that the ventilator of this invention could be used with other roofs, such as flat roofs, and with other roof constructions, such as asphalt or wood shingles or shakes, or slate or metal roof tiles or other roof system materials. In FIGS. 5 to 10, the roof ventilators have been shown having sealing skirts 64 or 66 depending from both sides of the support members. However, only one sealing skirt could be used if the application required this, or if other means such as dentil slips were used to fill the valleys in the roof tiles.

From the above, it will be appreciated that the roof ventilator of the present invention provides efficient and inconspicuous ventilation when used in conjunction with any suitable roof construction.

What I claim as my invention is:

1. A roof ridge or hip ventilator for longitudinal location along a roof ridge or hip having openings for the passage of air through and the roof surface, and roof ridge or hip cover elements covering said openings, the ventilator comprising: an elongate support member adapted to be located longitudinally, straddling said ridge or hip openings; the support member including longitudinal upright side portions having upper longitudinal peripheral edges for spacing said roof ridge or hip cover elements above the roof surface with the ridge or hip cover elements overhanging the side portions, the side portions having means defining vent openings for the passage of air therethrough, the support member also having a central inner portion connecting the longitudnal side portions, said inner portion having shield portions located adjacent to the side portion vent openings to prevent precipitation passing inwardly through the support member; and the central portion also having means defining vent openings communicating with the ridge or hip openings and the side portion vent openings for the venting of air through the roof ridge or hip with said ridge or hip cover elements in place.

2. A roof ridge ventilator as claimed in claim 1 and further comprising a longitudinal sealing skirt attached to and downwardly depending from one of said inner portion shield portions, the sealing skirt being formed of flexible material to conform to the roof surface contour.

3. A roof ventilator as claimed in claim 2 wherein the sealing skirt has a lower peripheral edge portion pre-shaped to conform to the roof surface contour.

4. A roof ventilator as claimed in claim 1 wherein the support member is one of a plurality of longitudinally arranged support members, some of said support members having no vent openings, thereby permitting the amount and location of roof ridge ventilation to be preselected.

5. A roof ventilator as claimed in claim 1 wherein the central inner portion is of inverted V-shape and wherein the side portions have lower edges, the central inner portion being connected to the bases of the respective longitudinal side portions.

6. A roof ventilator as claimed in claim 5 wherein the central inner portion has means defining top, spaced-apart slots for the passage of fasteners therethrough to attach the support member to the roof.

7. A roof ventilator as claimed in claim 6 wherein the central portion vent openings are located remote from said lower edges, so that said shield portions are located opposite the side portion vent openings.

8. A roof ventilator as claimed in claim 5 wherein the side portions further include spaced-apart drain openings located at the base thereof.

9. A roof ventilator as claimed in claim 7 wherein the central portion vent openings are outwardly opening louvres.

10. A roof ridge ventilator as claimed in claim 3 wherein said inner portion shield portions include means defining a longitudinal, C-shaped, downwardly opening retaining slot, and wherein the sealing skirt has an upper peripheral bead slidably located in said slot for longitudinal movement of the sealing skirt relative to the support member.

11. A roof ventilator as claimed in claim 1 wherein the support member is located on and straddles the roof ridge or hip openings, roof ridge or hip cover elements are located on the support members and are spaced above the roof surface by the support member, the support member central inner portion has means defining longitudinally spaced-apart fastener openings; and further comprising fastening means connected between the roof ridge or hip cover elements and the roof ridge or hip and passing through said spaced-apart fastener openings for attachment of the support member and the roof ridge or hip cover elements to the roof.

12. A roof ridge ventilator as claimed in claim 2 wherein the sealing skirt is formed of flexible ductile material, so that it can be shaped after installation of the support member to conform to the roof contour.

13. A roof ridge ventilator as claimed in claim 10 wherein the sealing skirt is formed of resilient material.

14. A roof ridge ventilator as claimed in claim 12 wherein the sealing skirt is formed of lead sheet material.

15. A roof ridge ventilator as claimed in claim 8 and further comprising a longitudinal sealing skirt attached to and downwardly depending from said inner portion shield portion, the sealing skirt being formed of flexible material to conform to the roof surface contour.

16. A roof ridge ventilator as claimed in claim 2 and further comprising a second, longitudinal, flexible sealing skirt, one of said sealing skirts being attached to and downwardly depending from each of said inner portion shield portions.

* * * * *